United States Patent [19]

Cottrell et al.

[11] Patent Number: 4,524,275

[45] Date of Patent: Jun. 18, 1985

[54] MULTIPLE COLLECTOR MASS SPECTROMETERS

[76] Inventors: John S. Cottrell, 33 Banford Rd., Manchester M20 8QP; Patrick J. Turner, 61 Altrincham Rd., Wilmslow, Cheshire; David J. Kay, 9 Redwood Close Barmton, Northwich, Cheshire, all of United Kingdom

[21] Appl. No.: 447,179

[22] Filed: Dec. 6, 1982

[30] Foreign Application Priority Data

Dec. 7, 1981 [GB] United Kingdom ..... 8136791

[51] Int. Cl.[3] ..... H01J 49/30

[52] U.S. Cl. ..... 250/298; 250/299; 250/396 ML

[58] Field of Search ..... 250/298, 299, 396, 396 ML

[56] References Cited

U.S. PATENT DOCUMENTS 3,522,428 8/1970 Powers ..... 250/299
4,174,479 11/1979 Tuithof et al. ..... 250/299 X

FOREIGN PATENT DOCUMENTS 1400532 7/1975 United Kingdom .
2018505 10/1979 United Kingdom .

OTHER PUBLICATIONS

Harald A. Enge, "Deflecting Magnets", pp. 203–263, from Septier, A., The Focusing of Charged Particles, Academic Press, New York, 1967.

H. H. Tuithof et al, "A Magnetic Mass Spectrometer with Simultaneous Ion-Detection and Variable Mass Dispersion in Laser Pyrolysis and Collision-induced Dissociation Studies", Adv. in Mass Spectrometry, vol. 7, pp. 838–845 (Heyden, London, 1978), 1976.

H. H. Tuithof et al, "Variation of the Dispersion, Resolution and Inclination of the Focal Plane of a Single-Focussing Mass Spectrometer by Use of Two Quadrupoles", Int. J. Mass Spectrometry and Ion Physics, 1976, 20, pp. 107–121.

Isao Takeshita et al, "A Prism Mass Spectrometer with Two Q Lenses", pp. 855–857, Adv. in Mass Spectrometry, 7 (Heyden, London, 1978).

N. W. Parker et al, "Design of Magnetic Spectrometers with Second-Order Aberrations Corrected. I: Theory", pp. 333–351, 86 Optik. vol. 51, No. 4, 1978.

R. F. Egerton, "Design of an Aberration-Corrected Electron Spectrometer for the TEM", pp. 229–242, 86 Optik, vol. 57 (1980) No. 2.

Extract from PhD Thesis of H. H. Tuithof, pp. 58–64, University of Delft, Mar. 1977.

G. J. Louter et al, "A Tandem Mass Spectrometer for Collision-Induced Dissociation", Int. J. Mass Spectrom. & Ion Phys., 1980, 33, pp. 335–345.

G. J. Louter et al, "Ion Optics of a Tandem Mass Spectrometer with Variable Dispersion and Simultaneous Detection: Second Stage", pp. 137–142, Nucl. Instr. & Methods, 1981, 187.

G. J. Louter et al, "Application of Matrix Calculation. I. The Design and Adjustment of a Tandem Mass Spectrometer for Collision-Activated Dissociation (CAD)", Int. J. of Mass Spectrom. & Ion Physics, 1981, vol. 39, pp. 197–218.

T. Matsuo et al, "Application of Quadrupole Lenses to Mass Spectrometers", Adv. in Mass Spectrometry 7, Heyden, London, 1978, pp. 851–854.

*Primary Examiner*—Alfred E. Smith
*Assistant Examiner*—Jack I. Berman
*Attorney, Agent, or Firm*—Bacon & Thomas

[57] ABSTRACT

In a mass spectrometer, suitable for use in the determination of isotope ratios, having as a mass selector a sector magnet and detector means for detecting and measuring the intensity of ion beams at two or more positions in the focal plane of said sector magnet, the improvement comprises providing the exit (and optionally also the entrance) pole face of said sector magnet with a curvature such that the focal plane of said sector magnet lies substantially at right angles to the ion optical axis as it passes through said focal plane. With this arrangement, motion of detector means between positions in said focal plane by means of mechanical linkages controlled from outside the vacuum system of the mass spectrometer is facilitated.

20 Claims, 7 Drawing Figures

FIG. 2.
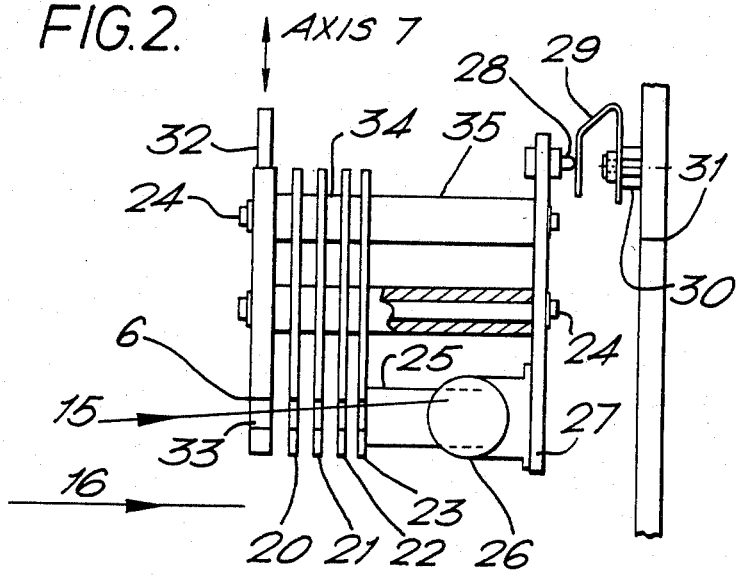
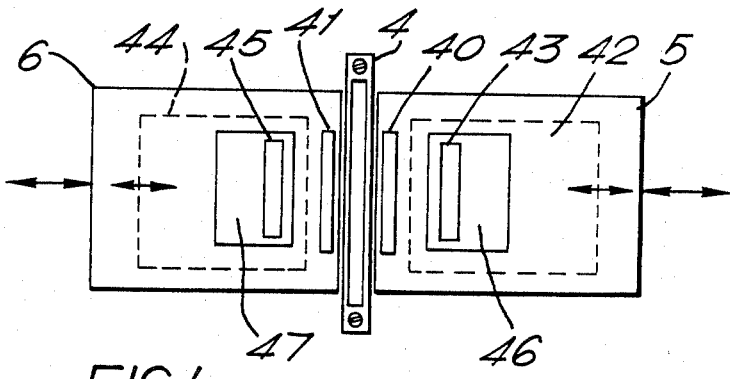
FIG. 4.

MULTIPLE COLLECTOR MASS SPECTROMETERS

TECHNICAL FIELD

This invention relates to mass spectrometers, in particular mass spectrometers for the determination of the isotopic composition of materials.

BACKGROUND ART

One method of determining the relative proportions of the isotopes of a chemical element present in a material is to subject the material to analysis by mass spectrometry. The type of mass spectrometer usually employed consists of an ion source for generating a beam of ions which are characteristic of the element(s) in the sample for which the isotopic analysis is required, a mass selector, which is usually a magnetic field at right angles to the direction of motion of the ions arranged to deflect the ion beam so that ions of different mass to charge ratios follow different trajectories, and an ion detector which produces an electrical signal related to the number of ions falling on it. A narrow slit (termed the collector slit) is positioned in front of the ion detector so that ions of only one particular mass to charge ratio can fall on the ion detector. As with all mass spectrometers, the path along which the ions travel must be maintained at a high vacuum. By variation of the strength of the magnetic field which deflects the ion beam, ions of different mass to charge ratio can be made to pass through the collector slit, and the relative intensities of different beams can be measured thus allowing the determination of the relative proportions of the isotopes present in the sample. Such mass spectrometers are well known and need not be described further.

When a mass spectrometer of this type is used to determine the ratio of the intensities of two ion beams corresponding to the isotopes of an element present in a sample, the magnetic field strength has first to be adjusted to allow ions of the first mass to charge ratio through the collector slit, and then readjusted to allow ions of the second mass to charge ratio to be determined. The accuracy of the ratio measurement will therefore be reduced if the total number of ions produced by the source should vary for any reason during the time that the measurements are being made. In practice, variations of this kind cannot be eliminated. It is known that this problem can be circumvented by the provision of two or more collector slits, each equipped with an ion detector, in place of the single collector slit and detector. These slits and detectors are positioned so that the first slit receives ions of the first desired mass to charge ratio, whilst simultaneously the second slit receives ions of the second desired mass to charge ratio, and so on. In this way the ion beam intensities corresponding to a number of mass to charge ratios can be measured simultaneously, and their values compared directly, so that the ratio between them can be determined accurately even if the absolute value of the intensity of all the beams changes for any reason. Another advantage of this method is that the time needed for the determination of a ratio is reduced in comparison with the method using only one collector slit and detector, because the measurements are made simultaneously. This means that a ratio can be accurately determined with a smaller quantity of sample than is necessary for the single collector system.

It will be appreciated that in separating ion beams of different mass to charge ratio, the magnetic field focusses the ion beam of a particular mass to charge ratio on to the collector slit, and that the position of the ion source and the collector slit, and the shape and size of the magnet poles, have to be selected to obtain the optimum focussing properties. If this is not done, the ion beams corresponding to only slightly different mass to charge ratios will overlap and their intensities cannot be accurately determined. The theory which may be used to calculate the geometrical arrangement of mass spectrometers to obtain the best results is well known and need not be described. This theory shows, and its predictions are confirmed in practice, that for a particular magnetic field strength, ion beams of different mass to charge ratios from the one focussed on the collector slit are in fact focussed at different points, and that these points lie on a plane which passes through the collector slit and is generally inclined at an angle to the ion optical axis of the magnet. In most cases, this angle is considerably smaller than 90°. In order to construct a multiple collector mass spectrometer of the type described it is therefore necessary to arrange the collector slits along this focal plane at the focal point of each of the ion beams which are to be determined, if resolution between the ion beams is to be maintained. Mass spectrometers constructed in this way are known, but suffer from two defects which detract from their performance.

The first defect is that the sensitivity and accuracy are lessened by the presence of a background signal on certain collectors in the presence of an intense ion beam falling on an adjacent collector, even when no ion beam is falling directly on the first collector. In general, collectors mounted behind the collector receiving the intense beam are the worst affected and the problem is attributed to off axis ions in the intense beam striking part of the collector assembly for that beam at a shallow angle and being deflected into an adjacent collector, especially one mounted behind the collector receiving the intense beam. This is a particular problem when measuring isotopic ratios because it is often necessary to measure the ratio of intensities of two beams differing in mass to charge ratio by only 1 or 2 daltons, when one beam is significantly less than 1% of the main beam. To obtain satisfactory performance it is therefore necessary to fit screens between the collector assemblies, but it is very difficult, if not impossible, to make these completely effective when the collectors are staggered along the focal plane, at a shallow angle to the direction of motion of the ions.

The second defect of the method is that if it is desired to change the mass/charge ratios for which the collectors have been positioned to receive, so that a different isotopic ratio can be determined, it is necessary to completely dismantle the collector assembly of the mass spectrometer and to make difficult mechanical modifications. In fact, if the changes required are large, an entirely new collector assembly may have to be manufactured. This difficulty arises because the spacing of the collectors for ion beams of different mass to charge ratios is dependent on the actual value of the mass/charge ratio as well as the difference between them. Further, because the magnets used in practice do not behave exactly in the manner predicted by theoretical treatments, it is not possible to calculate accurately the spacing needed between collectors for a particular set of mass to charge ratios. During the initial setting up procedure it is therefore necessary to make small adjustments to the positions of the collectors in order to ensure that they receive only the correct ion beam. Because each adjustment requires admitting air into the spectrometer and at least partial dismantling of the collector assembly, this procedure is very time consuming. Clearly, there would be considerable advantage from making the positions of the collectors adjustable from outside the vacuum system, but it is difficult to construct a mechanism which will move them along the focal plane of the magnet, because of its shallow inclination to the ion optical axis. Mechanisms which move the collectors at right angles to the optical axis are known, but are unsatisfactory because in moving the collector they also move it off the focal plane, thus reducing the resolution of the instrument. Consequently, these mechanisms can only be used for a very small range of adjustment, which is not sufficient to allow the instrument to be tuned to monitor different isotopic ratios.

It is the object of the present invention to provide a multicollector mass spectrometer which overcomes these difficulties, and which consequently has higher sensitivity and accuracy, and is easier to use and adjust, than previously known types.

DISCLOSURE OF THE INVENTION

Viewed from one aspect of the invention provides a mass spectrometer suitable for use in the determination of isotope ratios, said spectrometer having as a mass selector a sector magnet the exit pole face of which is curved such that the focal plane of said magnet is substantially perpendicular to the ion optical axis of said magnet, said spectrometer being provided with means for detecting ion beams at two or more positions in said focal plane simultaneously.

The sector magnet is preferably a stigmatic magnet in which the exit and/or entrance pole faces are inclined to the ion optical axis. This kind of magnet has the advantage that the ion beams may be focussed in both the y and z directions, i.e., both directions perpendicular to the ion optical axis. The exit pole face is preferably formed with a radius of curvature $R_2$ substantially given by $$R_2 = \frac{R}{C_2 \cos^3\beta} \text{ and}$$

$$C_2 = \frac{-2}{\tan\beta}\left(\tan^4\beta + \frac{5}{4}\tan^2\beta + \frac{1}{8}\right)$$

where R is the radius of the sector magnet itself, $\beta$ is the angle of inclination of the exit pole face to a normal drawn at the point where the ion optical axis cuts the said magnetic pole face with $\tan\beta = 0.5 \tan(\phi/2)$, $\phi$ being the deflection angle. For a 90° stigmatic sector magnet the radius of curvature of the exit pole face is preferably about 0.7 R, the curvature being such that the exit pole face is concave.

Viewed from another aspect, there is provided a magnetic sector mass spectrometer which is so constructed that the focal plane of the magnet lies at substantially 90° to the ion optical axis, by the use of a magnet fitted with pole pieces which are suitably curved on the exit face and optionally on the entrance face, said mass spectrometer incorporating a collector system which consists of two or more collectors, arranged along said focal plane, at least one of which can be moved along said focal plane by mechanical linkages controlled from outside the vacuum system.

In this way the collectors, which each comprise collector slits and ion detectors, can be adjusted independently, without the need to dismantle any part of the mass spectrometer, so that each one is in the optimum position to receive the ion beam which it is intended to measure, and also to receive different ion beams if the spectrometer is to be adjusted to measure ion beams with different mass to charge ratios. It will be appreciated that the design of a mechanism for this purpose is greatly facilitated if the plane along which the slits have to be moved is at 90° to the optical axis. In addition, when the collectors are mounted on a plane at right angles to the optical axis, it becomes much less likely that charged particles scattered from one collector will pass into an adjacent collector, and consequently the background signal problem described above is greatly reduced, leading to an improvement in the accuracy of the isotopic ratio determinations.

Preferably, the collector system comprises three collector slits and detectors, one slit and detector being fixed and the others being movable in the focal plane transversely to the optical axis. However, the invention now enables collector systems having a greater number of slits and detectors to be realised. For example, it is possible relatively easily to provide a collector system having one fixed slit and detector and a large number of movable ones thereby providing an instrument of great flexibility of operation. It is only necessary to provide each moveable collector with some means of adjusting its position from outside the vacuum system, which is greatly facilitated when the focal plane of the magnet is at right angles to the optical axis. In many cases, it is not necessary to adjust the position of all the collectors independently from outside the vacuum system, and it will be acceptable to control the position of some of the collectors as a pair, with a preset adjustment being provided for the distance between them. The invention therfore allows the construction of mass spectrometers with a greater number of collectors than was possible previously.

The focal plane of the magnet is rotated to its desired position at right angles to the optical axis by suitably curving its exit pole face, but this also tends to increase certain aberrations in the focussing behaviour of the magnet, reducing the resolution of the spectrometer. These aberrations may be reduced or eliminated by the use of one or more additional electrostatic or magnetic quadrupoles but preferably we provide a curved magnet entrance pole face. It has been found that by curving the entrance pole face of the magnet as well as the exit pole face, the aberrations can be reduced to a value approaching those obtained with straight pole faces, whilst still achieving rotation of the focal plane to its desired position at 90° to the optical axis.

Thus, viewed from another aspect the invention provides a mass spectrometer for use in the determination of isotope ratios, said spectrometer having as a mass selector a sector magnet the exit and entrance pole faces of which are curved such that the focal plane of said magnet is substantially perpendicular to the ion optical axis of said magnet, said spectrometer being provided with means for detecting ion beams at two or more positions in said focal plane.

The radius of curvature of the entrance pole face of the sector magnet will suitably be greater than that of the exit pole face and the curvature itself will be of the opposite sense.

DETAILED DESCRIPTION OF THE INVENTION

FIGS. 2 and 3 are plan and front views showing details of a collector assembly which might be used with the invention.

FIG. 4 shows how the assembly of FIGS. 2 and 3 might be modified to include a greater number of collectors.

Figure 1:
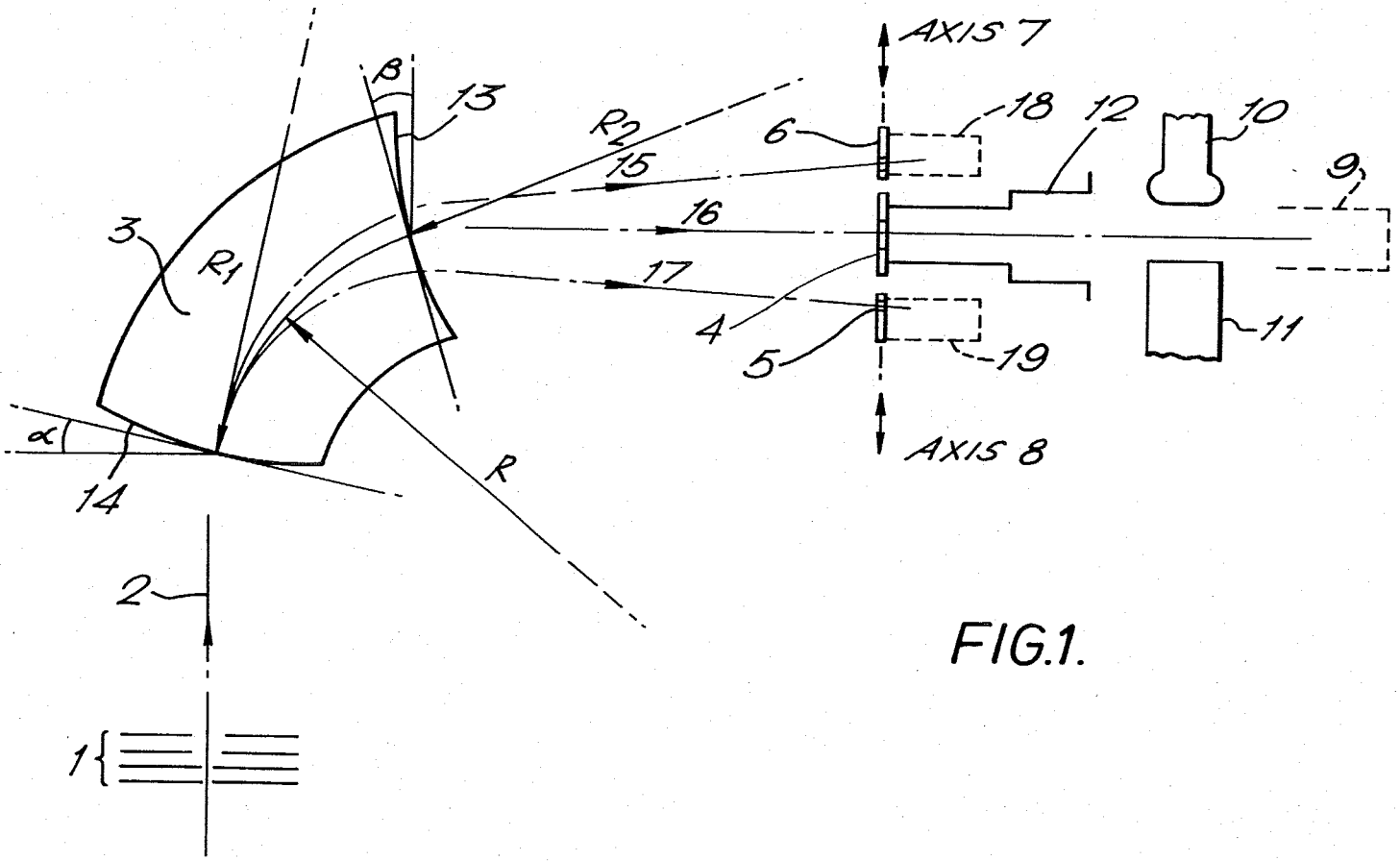
FIG. 1 is a plan view showing the ion optical arrangement of one type of single focussing mass spectrometer which is constructed in accordance with the present invention.

It will be appreciated that this invention is not limited to the type of mass spectrometer illustrated in FIG. 1, but can be applied to many types of single focussing magnetic sector mass spectrometers, or to multiple focussing spectrometers in which a magnet is the last focussing element through which the ions pass before reaching the collector assembly. Also, the invention is not limited to the form of collector construction illustrated in FIGS. 2 to 7, and other methods of moving the collectors along the focal plane of the magnet might also be used.

Referring to FIG. 1, ions are generated in the ion source 1, which may be of any known type suitable for generating ions from the sample to be analysed, and travel along trajectory 2 towards the poles of magnet 3. On passing between the magnet poles, the ions are separated into beams of different mass to charge ratio, of which three are shown in FIG. 1. Dependent on the setting of the magnetic field strength, ions of the highest mass to charge ratio which it is desired to measure are deflected by the magnet and follow trajectory 15, passing through a slit in plate 6 to enter collector assembly 18, whilst ions of a lower mass to charge ratio will follow trajectory 17 to pass through a slit in plate 5 to enter collector assembly 19. Ions of an intermediate mass to charge ratio will follow trajectory 16, the optical axis of the spectrometer, and pass through a slit in fixed plate 4 and rectangular drift tube 12 into collector assembly 9. Alternatively, if a high potential of polarity opposite to the charge on the ions is applied to electrode 10, then ions leaving the tube 12 will be deflected to collide with electrode 10, emitting secondary electrons which will pass into scintillator detector 11. The provision of collector assembly 9, electrode 10 and detector 11 is a conventional feature of single collector mass spectrometers intended for this type of measurement.

In accordance with the invention, the magnet 3 is arranged such that the focal plane, in which the slit plates 4, 5 and 6 lie, is at substantially 90° to the optical axis 16.

Collector assemblies 18 and 19, mounted on collector slit plates 6 and 5 respectively, can be moved along axes 7 and 8 so that the slits coincide with beams 15 and 17, by means of vacuum sealed micrometer linear drives mounted on the vacuum housing of the spectrometer. Such drives are common features of modern mass spectrometers and are well-known. Axes 7 and 8 lie along the focal plane of magnet 3 which, by virtue of the curvature 13 on the exit pole face of the magnet is approximately at 90° to the trajectory 16, the ion optical axis.

FIG. 2 illustrates the construction of the movable collector assembly 18. Collector assemblies 19 and 9 are made in a similar way. Referring to FIG. 2, collector slit plate 6, incorporating the aperture 33 through which the ions pass, is connected by link 32 to the linear motion drive. Three rods 24 of an insulating material such as ceramic, and spacers 34 and 35 secure plates 20, 21, 22, 23 and 27. Plate 23 carries the Faraday bucket ion detector 25, and plate 27 carries two small magnets 26, spaced either side of bucket 25. The purpose of magnets 26 is to minimize the chance of secondary electrons, emitted when an ion strikes the wall of bucket 25, leaving the bucket. Plate 21 is maintained at a potential of about −100 V to ensure that any electrons that do escape from the bucket are returned to it. Plates 20 and 22 are earthed and serve as electrostatic screens. Connections to the bucket 25 and plate 21 are made via two contacts 28 which are in sliding contact with flexible spring loaded contacts 29 mounted on fixed plate 31 by means of insulators 30.

Figure 3:
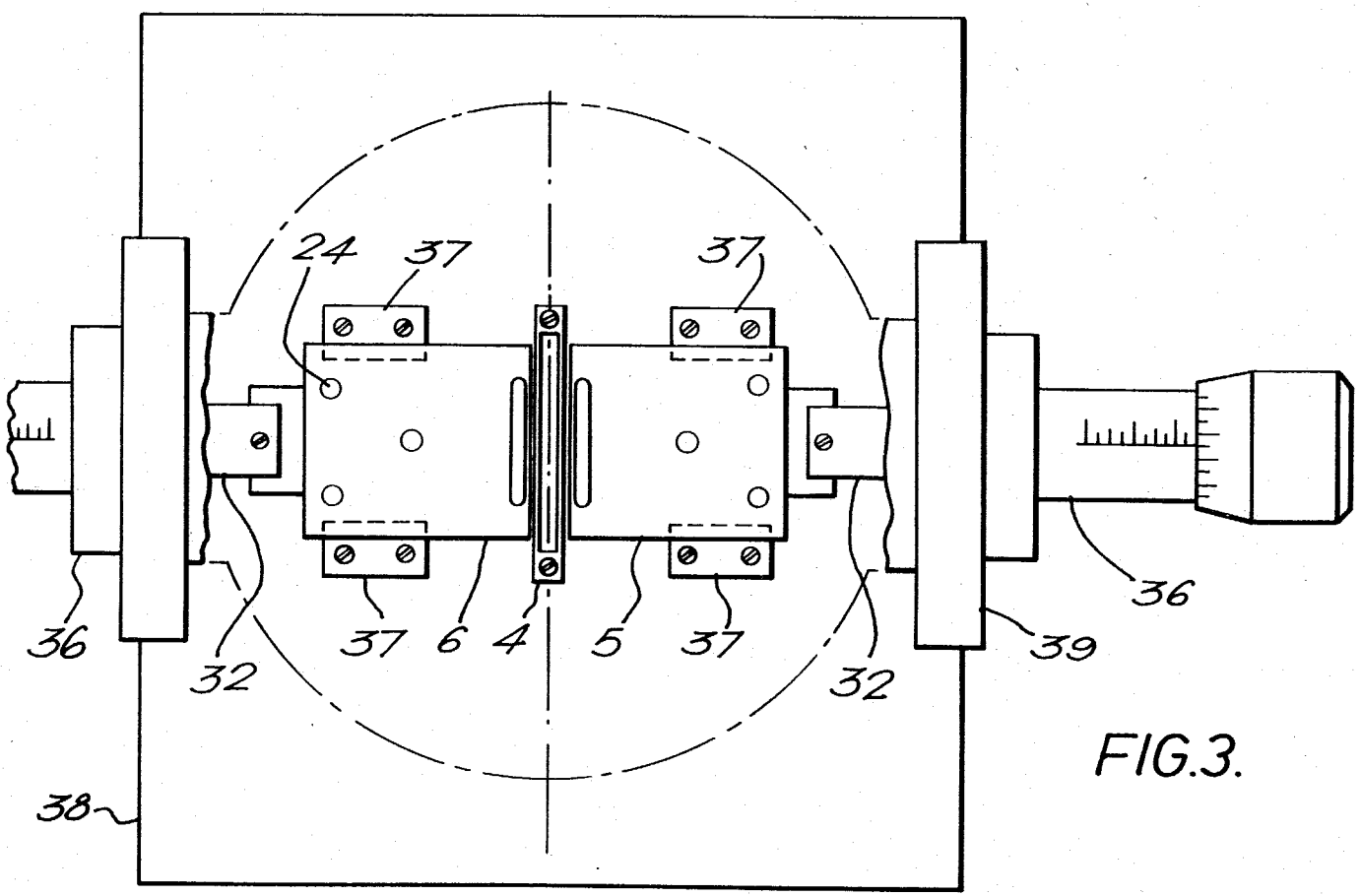

FIG. 3 is a simplified view of the collector assemblies as seen from a viewpoint situated on the ion optical axis 16, with the mounting plate which supports fixed slit plate 4 and guides 37 removed for clarity. Sliding slit plates 5 and 6 are maintained in position by guides 37 in such a way that all the slit apertures lie in the focal plane of the magnet. Collector assemblies 19 and 18 are secured to plates 5 and 6 by the rods 24, and plates 5 and 6 are connected by links 32 to the vacuum sealed micrometer linear drives 36. Drives 36 are attached to ports in vacuum housing 38 by gold wire sealed flanges 39.

It will be seen that other methods of moving slit plates 5 and 6 might be adopted, for example, an electrical positioner, or a mechanism based on a bimetallic strip could be used. Further, the number of slits need not be limited to 3. FIG. 4 indicates how the number of collector slits might be increased to five. Sliding plates 5 and 6, incorporating the usual ion beam apertures 40 and 41 also incorporate larger apertures 46 and 47. Two smaller sliding slit plates 42 and 44, containing slit apertures 43 and 45, are positioned behind plates 5 and 6 so that apertures 43 and 45 are exposed through larger apertures 46 and 47. The positions of plates 44 and 42 are adjusted to receive ion beams of greater mass to charge ratio than beam 15, and smaller mass to charge ratio than beam 17, respectively. Collector assemblies similar to assembly 18 are mounted on each sliding slit plate with the provision in the rear plates 42 and 44 of clearance slots through which mounting rods 24 of the collector assemblies on slit plates 5 and 6 can pass. The positioning of each dual sliding slit assembly can be achieved by use of dual concentric micrometer drives, the outer sections of which control slit plates 5 and 6, and the inner sections slit plates 42 and 44. In this way the collector system can be adjusted to receive five ion beams simultaneously without dismantling any part of the spectrometer.

Figure 5:
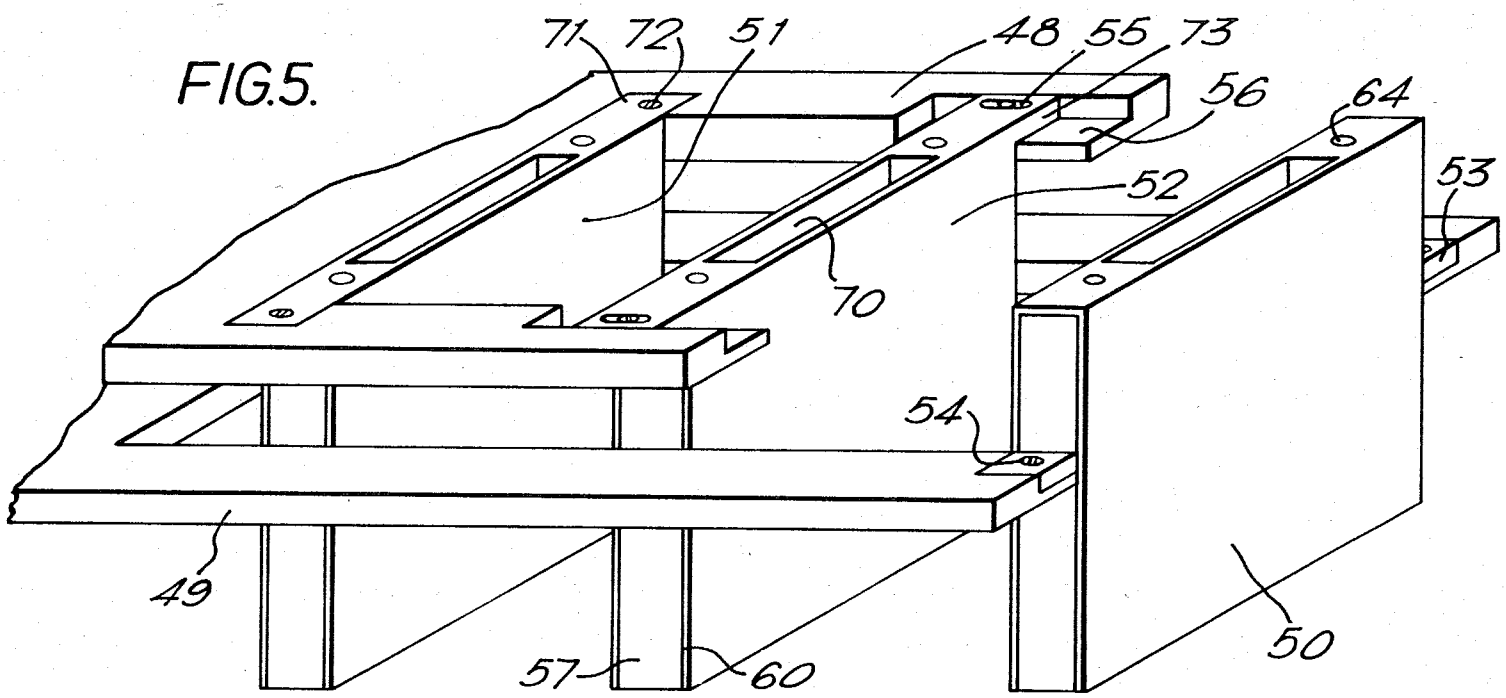
FIG. 5 shows part of a further collector assembly which might be used with the invention and is particularly suitable for use when more than 3 collectors are required.
Figure 6:
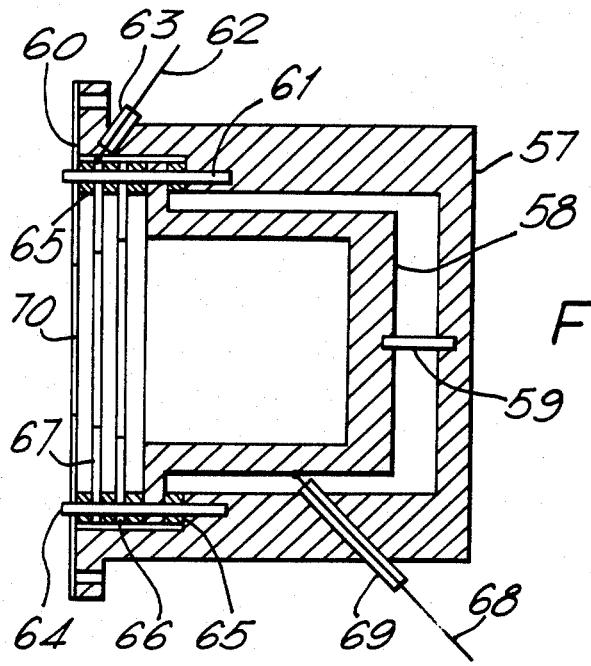
FIG. 6 shows a sectional view of an individual collector for use in the assembly of FIG. 5.
Figure 7:
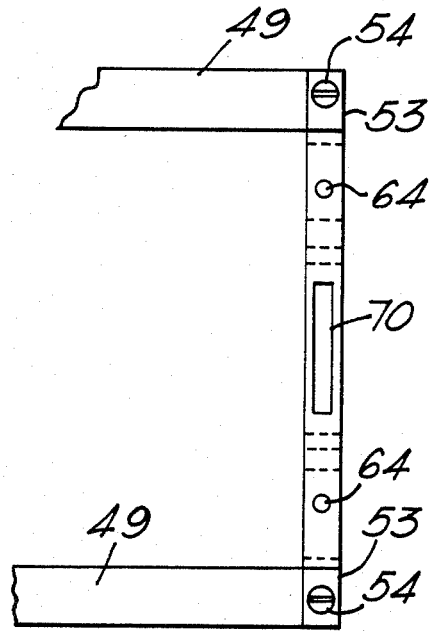
FIG. 7 shows the front view of the collector of FIG. 6 assembled as shown in FIG. 5.

Although the collector assembly illustrated in FIGS. 2, 3 and 4 is suitable for a collector system involving up to 5 separate collectors, it is often more convenient to construct multiple collector systems involving three or more collectors as shown in FIGS. 5, 6 and 7. These illustrate the assembly of a collector system with seven separate collectors. The collectors are disposed with one fixed slit on the ion optical axis, and three moveable collectors on either side of the fixed slit. Referring to FIG. 5, which shows the arrangement of the three moveable slits on one side, each collector assembly generally indicated by 50, 51 and 52 is built inside a thin screened box, and is described in greater detail below. Collector assembly 50, which is adjacent to the fixed slit, is mounted on a forked plate 49 by means of lugs 53 and screws 54. Plate 49 may replace the sliding plate 42 or 43 of FIG. 4, and is free to slide in a pair of phosphor bronze guides similar to 37 in FIG. 3. Plate 49 is connected at its solid end to one section of a dual concentric micrometer drive (not shown), or other suitable moving means. The remaining two collectors, 51 and 52, are mounted on a second forked plate 48 by lugs 71 and 73 and screws 72 and 55 respectively. Plate 48, which may replace one of slit plate 5 or 6 of FIG. 4, is also free to slide in a pair of guides, independently of plate 49. Its position is controlled by the other section of the dual concentric micrometer drive. As shown in FIG. 5, the positions of the guides for plates 48 and 49, and the lugs 71, 73 and 53 on the sides of the collectors are arranged so that the entrance slits of each collector, i.e., the top surfaces visible in FIG. 5, are in the same plane, and this plane is arranged to be the focal plane of the magnet. Collector 52 is further arranged so that it can be moved relative to collector 51 by provision of recesses 56 in the ends of forks 48, and slotted holes in lugs 73. This permits the distance between collectors 51 and 52 to be adjusted to any desired value. A disadvantage of this arrangement is that it clearly does not allow the independent positioning of all the collectors from outside the vacuum system, but it does permit the construction of a seven collector system which uses only conventional components and requires only two preset adjustments.

Collector assemblies 50, 51 and 52 are illustrated in more detail in FIG. 6, which shows a sectional view of one of them. Each collector consists of a shaped flat plate 57 of thickness almost equal to that of the entire assembly which is enclosed by a thin metallic sheet 60, bent into a "U" shape and fitted over the open end of plate 57 to form a box, completely enclosed except for the entrance slit 70 (see also FIGS. 5 and 7). Inside the box so formed another shaped plate 58 is supported on two ceramic rods 64, spaced away from the ledges formed in plate 57 by insulators 65. Plate 58 is thinner than plate 57, and is covered on each side by a thin metallic sheet so that another enclosed box is formed, with an open end facing slit 70. A short ceramic rod 59 maintains the two boxes in the correct position and ensures that box 58 does not contact box 57 at any point. Two elongate thin metallic plates 66 and 67, containing slits similar to, but usually slightly larger than slit 70, are also supported on ceramic rods 64 and spaced apart by insulators 65 as shown. This assembly is maintained in position by the outer cover 60, which in turn is secured to the edge of plate 57 by two screws, which may also serve to mount the collector to plate 48. In the case of collector 50, where lugs 53 are mounted lower down the sides of plate 57, extra screws must be provided. The inner box formed partly by plate 58 serves as the collector bucket and is connected through lead 68 which passes through the outer screening box 57 through insulated tube 69. Plate 67 is the supressor electrode, similar to plate 21 in FIG. 2, and is maintained at approximately −100 volts by means of lead 62 passing through insulated tube 63. Plate 66 is earthed and serves as an electrostatic screen. Thus the outer screening box consisting of plate 57 and cover 60 completely encloses the collector 58 and the associated plates 66 and 67, so that no scattered ions or secondary electrons can escape and enter an adjacent collector. This type of collector assembly is more compact than that shown in FIG. 2 and may be used with advantage in any multiple collector system where space is limited.

Magnet 3 may be of any known type providing that it has a homogeneous field and that the curvature of the exit pole face and optionally the entrance pole face is determined in accordance with the method described below. In the example given in FIG. 1, a stigmatic magnet is shown, because such magnets are often employed on mass spectrometers of this type. These magnets are arranged to focus ions not only in the plane in which FIG. 1 is drawn, but also in a plane at right angles to it, that is, parallel to the magnetic field between the poles of magnet 3. A conventional stigmatic magnet has straight entrance and exit pole faces, and the focussing in the perpendicular plane is achieved by inclining these at a suitable angle to the optical axes 2 and 16. In many cases, advantage is also gained by making the angle of the exit pole face adjustable, so that any deviations from the predicted behaviour can be compensated for when using a practical magnet.

The radius of curvature of the exit pole face required to rotate the focal plane to 90° to the ion optical axis is dependent on the type of magnet used. In order to calculate the curvature required it is necessary to calculate the theoretical behaviour of the magnet, following for example, the methods outlined by H. A. Enge, in "Focussing of Charged Particles", Edited by Albert Septier, published by Academic Press, New York, in 1967. The procedure is complicated and it is not possible to state equations from which the curvature may be calculated for all possible types of magnets. Consequently, there may be some particular geometries for which the focal plane cannot be rotated to the correct position by this method, either for practical or theoretical reasons. This could only be established by performing a very large number of calculations which would be very time consuming. However, it will be apparent from the equations derived for a particular magnet whether or not it is possible to rotate the focal plane in the manner of the invention. By way of an example, for a symmetrical stigmatic magnet of radius R, and of deflection angle $\phi$, which is a type commonly employed, the following relations can be shown to be applicable:

$$a = b = \frac{2R}{\tan(\phi/2)}$$

$$\tan\alpha = \tan\beta = \tfrac{1}{2}\tan(\phi/2)$$

$$R_2 = \frac{R}{C_2\cos^3\beta}$$

$$C_2 = \frac{-2}{\tan\beta}\left(\tan^4\beta + \frac{5}{4}\tan^2\beta + \tfrac{1}{8}\right)$$

where a is the object distance (between the magnet pole and the source);

b is the image distance (between the magnet pole and the collector);

$\alpha$ is the entrance angle (between the entrance pole face and a line normal to the optical axis);

$\beta$ is the exit angle (between the pole face and a line normal to the optical axis);

$C_2$ is a parameter related to the exit pole face curvature;

$R_2$ is the radius of curvature of the exit pole face, needed to orientate the focal plane at 90° to the ion optical axis.

The value of $R_2$ can therefore be obtained from these equations, knowing $\phi$ and R, which are properties of the magnet system being considered.

In the case of a 90° stigmatic magnet, then $\alpha=\beta=26.565°$; therefore the required radius of curvature of the exit pole face is $-0.6988$ R.

In practice, however, the effective boundaries of the magnet poles are not identical with the actual boundaries of the poles because of the fringing fields of the magnet. Following Enge's method, the actual radius of curvature required ($Rm_2$) can be calculated from the equation $$C_2 = \frac{R}{(Rm_2 + 0.8D)\cos^3\beta} + \frac{0.7RD}{W^2\cos^3\beta}$$

$$\text{(i.e. } Rm_2 = R/(\cos^3\beta[C_2 - (0.7RD/W^2\cos^3\beta)]) - 0.8D)$$

where W is the width of the magnet poles (in the y direction, i.e. at right angles to $R_1$ and $R_2$ respectively in the plane of FIG. 1) and D is the poleface separation of the magnet (the gap between the N and S poles of the magnet).

As mentioned above, the exit pole face is advantageously made adjustable. This may be done by making the exit pole face of the magnet a concave hemispherical surface and clamping in it a mating piece with a pole face curved in accordance with the invention. The mating piece can be clamped at any desired angle and still fit snugly in the fixed part of the magnet pole. A similar device is known in some stigmatic magnets with flat faces.

As has been discussed above, curving the exit pole face 13, although resulting in the rotation of the focal plane to the desired position, also increases the aberrations of the magnet in focussing the ion beam. These aberrations can largely be compensated for by introducing a curvature 14 on the entrance pole face of the magnet. The radius of curvature of pole face 14 can be estimated by computing the likely effect of a given curvature on the most important aberration terms appearing in the equations which describe the focussing properties of the magnet, and selecting a value which results in the smallest aberrations. Such a procedure, although complex, will be familar to those engaged in the design of magnets for focussing beams of charged particles. For the magnet shown in FIG. 1, a value lying in the range:

$$0 \leqq C_1 \leqq -C_2$$

can be used, where $C_1$ and $C_2$ are the curvature parameters of the entrance and exit pole faces respectively and $$R_1 = \frac{R}{C_1\cos^3\alpha}.$$

The precise value is preferably adjusted by experiment to obtain the best performance. As in the case of the exit pole face curvature, it is possible that adequate correction will not be obtained with certain magnet geometries, but once again this will be apparent from the magnitude of the aberration terms in the focussing equations derived for the magnet in question.

In general, it is found that six of the aberration coefficients calculated by Enge's method vary with $C_1$ and $C_2$ and the remainder are not affected. If the values of these six are plotted against $C_1$ for the chosen value of $C_2$, $C_1$ may be determined at the point where the most significant terms are lowest, or cancel each other out, as some are of opposite sign. This point depends on the spectrometer geometry because the aberration terms contain parameters such as R, $\alpha$, $\beta$, $\phi$, etc. When $C_1$ is greater than $-C_2$ the plots show that all six aberration terms increase very steeply, so the upper limit of $C_1$ may be taken as $-C_2$. When $C_1$ is less than $-C_2$ but greater than zero, the variation of the aberration coefficients with $C_1$ is usually relatively small, and an approximate value for $C_1$ which results in the minimum aberration can easily be selected. For the 90° symmetrical stigmatic magnet described above, a value of $R_1=-1.14R_2$, i.e. $C_1/C_2=-0.88$, is found to be satisfactory. It is best to make a fine adjustment of $R_1$ starting from its calculated value, to optimise the performance.

As indicated in FIG. 1, $R_1$ and $R_2$ are measured along the normal to the original face of the magnet where it is cut by the ion optical axis 16. The distance along axis 16 in the magnetic field between the curved pole faces must be exactly the same as it was for the magnet with straight pole faces, otherwise the magnetic sector angle will be different and the magnet will not focus. This means in effect that the concave exit face has the corners of the pole faces built up and the convex entrance face has the corners removed. In all other aspects the construction of magnet 3 may be identical with that of a conventional magnet of the same type with straight pole faces, and need not be desribed in greater detail here.

We claim:

1. An isotope ratio mass spectrometer suitable for use in the determination of isotope ratios, comprising; a mass selector including, a stigmatic sector magnet having a focal plane, an ion optical axis, entrance and exit pole faces which are inclined to said ion optical axis in order to cause at least first order focusing in two mutually perpendicular planes simultaneously, said exit pole face being so curved as to cause said focal plane to be substantially perpendicular to said ion optical axis; and means for detecting ion beams at a plurality of positions in said focal plane simultaneously, wherein focussing of ions on said focal plane is achieved solely by said stigmatic sector magnet.

2. An isotope ratio mass spectrometer as claimed in claim 1 in which the radius of curvature ($R_2$) of said exit pole face is substantially given by:

$$R_2 = R/C_2\cos^3\beta).$$

where R is the radius of said sector magnet, $\beta$ is the angle of inclination of said exit pole face to a normal drawn at the point where said ion optical axis cuts said exit pole face, and $C_2$ is given by:

$$C_2 = -2(\tan^4\beta + (5/4)\tan^2\beta + \tfrac{1}{8})/\tan\beta.$$

in which the negative sign indicates that the curvature of said exit pole face is concave.

3. An isotope ratio mass spectrometer as claimed in claim 1 wherein the actual radius of curvature ($Rm_2$) of said exit pole face is given by:

$$Rm_2 = R/(\cos^3\beta(C_2 - (0.7RD/W^2\cos^3\beta))) - 0.8D$$

where R is the radius of said sector magnet, $\beta$ is the angle of inclination of said exit pole face to a normal drawn at the point where said ion optical axis cuts said exit pole face, D is the distance between the north and south poles of said magnet, W is the distance between said exit and entrance pole faces of said magnet measured along said ion optical axis, and $C_2$ is given by:

$$C_2 = -2(\tan^4\beta + (5/4)\tan^2\beta + \tfrac{1}{8})/\tan\beta.$$

in which the negative sign indicates that the curvature of said exit pole face is concave.

4. An isotope ratio mass spectrometer as claimed in claim 1 wherein the deflection angle of said magnet is substantially 90° and the angle of inclination of said exit and entrance pole faces to a normal at the optical axis is substantially 26.6°.

5. An isotope ratio mass spectrometer as claimed in claim 4 wherein the radius of curvature of said exit pole face is substantially 0.7 times the radius of the magnetic sector, and is such that the curvature of said exit pole face is concave.

6. An isotope ratio mass spectrometer as claimed in claim 1 wherein said entrance pole face is provided with a curvature selected to minimize second order aberrations in the focusing of said magnet.

7. An isotope ratio mass spectrometer as claimed in claim 6 wherein the radius of curvature of said entrance pole face is greater than, and of opposite sense to, the radius of curvature of said exit pole face.

8. An isotope ratio mass spectrometer as claimed in claim 4 wherein the radius of curvature of said entrance pole face is substantially 1.14 times that of said exit pole face, and said entrance pole face is convex.

9. An isotope ratio mass spectrometer as claimed in claim 1 having a collector system comprising two or more collectors arranged along said focal plane, at least one of which can be moved along said focal plane by a mechanical linkage controlled from outside the vacuum system.

10. An isotope ratio mass spectrometer as claimed in claim 6 having a collector system comprising two or more collectors arranged along said focal plane, at least one of which can be moved along said focal plane by a mechanical linkage controlled from outside the vacuum system.

11. An isotope ratio mass spectrometer as claimed in claim 1 having a collector system comprising three or more collectors arranged substantially along said focal plane, one of which is fixed and the others being independently movable along said focal plane and transversely to said ion optical axis.

12. An isotope ratio mass spectrometer as claimed in claim 6 having a collector system comprising three or more collectors arranged substantially along said focal plane, one of which is fixed and the others being independently movable along said focal plane and transversely to said ion optical axis.

13. An isotope ratio mass spectrometer as claimed in claim 1 having a collector system comprising three or more collectors arranged substantially along said focal plane, one of which is fixed and at least two of which are mounted on a common supporting means which can be moved in said focal plane transversely to said ion optical axis, said supporting means incorporating a preset means to allow adjustment of the distance between the collectors mounted on it.

14. An isotope ratio mass spectrometer as claimed in claim 6 having a collector system comprising three or more collectors arranged substantially along said focal plane, one of which is fixed and at least two of which are mounted on a common supporting means which can be moved in said focal plane transversely to said ion optical axis, said supporting means incorporating a preset means to allow adjustment of the distance between the collectors mounted on it.

15. An isotope ratio mass spectrometer as claimed in claim 13 in which at least a further one of said collectors is independently movable in said focal plane transversely to said ion optical axis.

16. An isotope ratio mass spectrometer as claimed in claim 14 in which at least a further one of said collectors is independently movable in said focal plane transversely to said ion optical axis.

17. An isotope ratio mass spectrometer suitable for use in the determination of isotope ratios, comprising; a mass selector including, a stigmatic sector magnet having a focal plane, an ion optical axis, entrance and exit pole faces which are inclined to said ion optical axis in order to cause at least first order focusing in two mutually perpendicular planes simultaneously, said exit pole face being so curved as to cause said focal plane to be substantially perpendicular to said ion optical axis, and said entrance pole face being so curved as to reduce exit pole face induced aberration; and means for detecting ion beams at a plurality of positions in said focal plane simultaneously, wherein focussing of ions on said focal plane is achieved solely by said stigmatic sector magnet.

18. An isotope ratio mass spectrometer as defined in claim 17 having a collector system comprising three or more collectors arranged substantially along said focal plane, one of which is fixed and the others being independently movable along said focal plane and transversely to said ion optical axis.

19. An isotope ratio mass spectrometer as claimed in claim 17 having a collector system comprising three or more collectors arranged substantially along said focal plane, one of which is fixed and at least two of which are mounted to a common supporting means which can be moved in said focal plane transversely to said ion optical axis, said supporting means incorporating a preset means to allow adjustment of the distance between the collectors mounted on it.

20. An isotope ratio mass spectrometer as defined in claim 19 in which at least a further one of said collectors is independently movable in said focal plane transversely to said ion optical axis.

* * * * *